United States Patent [19]

Marhic et al.

[11] 4,220,889

[45] Sep. 2, 1980

[54] CATHODE FOR AN ELECTRON GUN

[75] Inventors: Gerard Marhic, Chaumont en Vexin; Philippe Martin, Orsay, both of France

[73] Assignee: Commissariat a l'Energie Atomique, Paris, France

[21] Appl. No.: 14,832

[22] Filed: Feb. 26, 1979

[30] Foreign Application Priority Data

Mar. 1, 1978 [FR] France ..... 78 05813

[51] Int. Cl.[2] ..... H01J 1/15; H01J 19/16

[52] U.S. Cl. ..... 313/38; 313/270; 313/341

[58] Field of Search ..... 313/270, 38, 337, 341

[56] References Cited

U.S. PATENT DOCUMENTS

| | | | |
|---|---|---|---|
| 2,498,775 | 2/1950 | Watrous, Jr. | 313/38 |
| 3,440,475 | 4/1969 | Schiller et al. | 313/270 X |
| 3,532,923 | 10/1970 | Vogel | 313/341 |
| 3,958,146 | 5/1976 | Buescher et al. | 313/337 X |
| 4,068,145 | 1/1978 | Nakagawa et al. | 313/341 X |

*Primary Examiner*—Alfred E. Smith
*Assistant Examiner*—Charles F. Roberts
*Attorney, Agent, or Firm*—Lee C. Robinson, Jr.

[57] ABSTRACT

A cathode for an electron gun in which a lanthanum hexaboride cap has an internal recess which accommodates a pyrolytic graphite heater element. The cap is cup-shaped, while the heater element is in the form of a frustum of a cone and is resiliently maintained in abutting relationship with the cap by a corrugated tubular member and an assembly of rigid tubes. A cylindrical shell surrounds the periphery of the cap, and a pair of generally conical shielding elements are located in position to intercept stray thermal radiation from the heater element. All of these cathode components are supported in coaxial relationship with each other within the electron gun.

15 Claims, 1 Drawing Figure

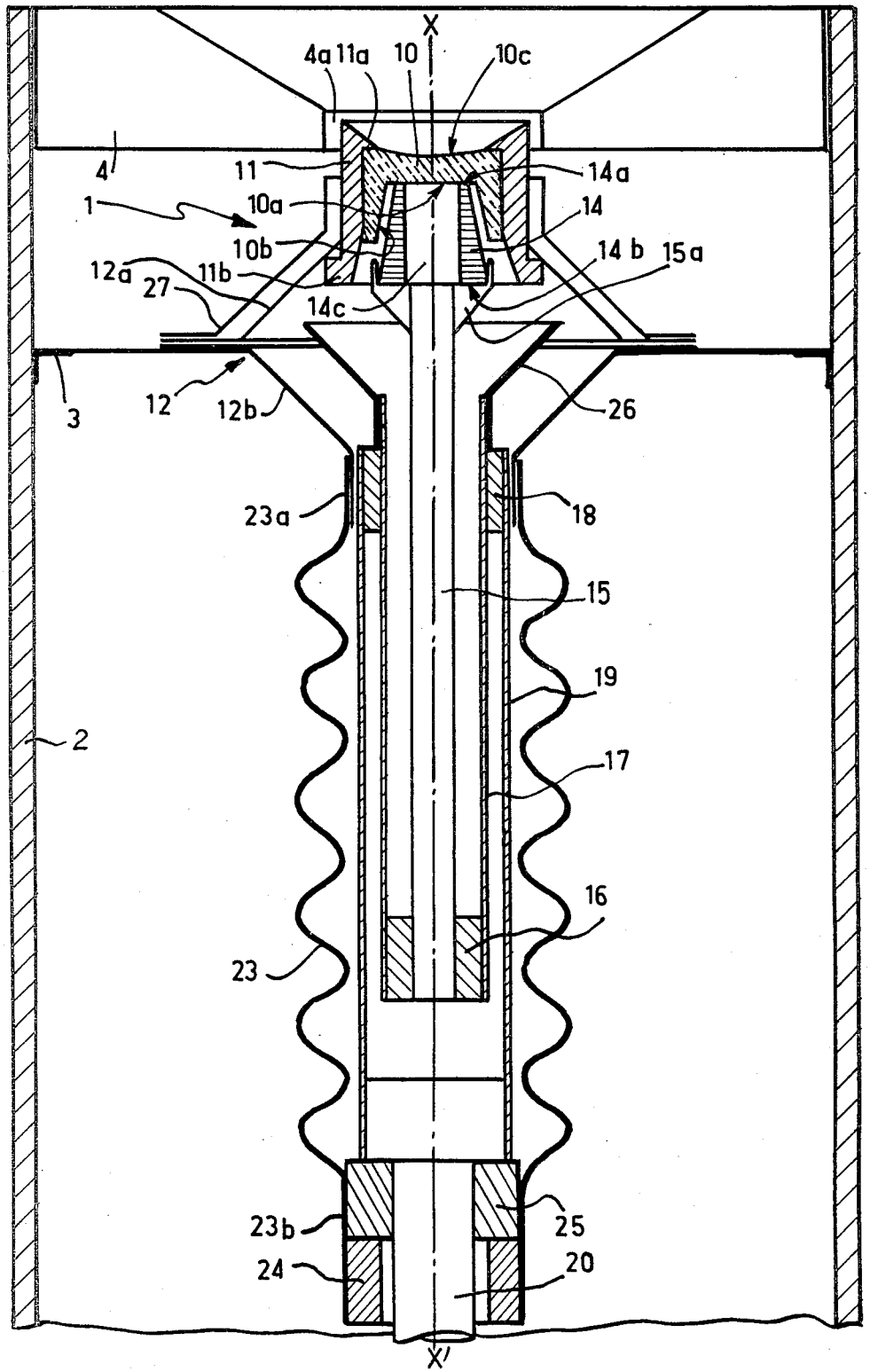
X
4a
11a
10
10c
4
11
14a
1
10a
14
10b
14 b
15a
12a
11b
27
14c
3
12
12b
26
23a
18
15
19
2
17
16
23
23b
25
24
20
X'

CATHODE FOR AN ELECTRON GUN

BACKGROUND OF THE INVENTION

This invention relates to a cathode for an electron gun and more particularly to a cathode having a cap member of a material which is capable of emitting electrons at an elevated temperature and a heater element of high electric resistivity.

As is well known, the cathode in an electron gun is used to generate a stream of electrons which forms an electron beam. The electrons commonly are subjected to the action of a Wehnelt cylinder which regulates the intensity of the beam and are accelerated by a voltage applied between the cathode and the anode of the device. A magnetic lens is used to focus the electrons on a generally point-shaped surface.

Heretofore, cathodes of the foregoing type have used a cap member which at least in part was in the form of a rectangular parallelepiped. Two cubical blocks of pyrolytic graphite or other high resistivity material were disposed on either side of the cap to provide a heating element. The whole was mounted on a stationary support comprising a pair of rigid metallic arms connected to a source of electric current. The arms were in direct contact with the graphite blocks to hold them against the cap.

Such prior cathodes have exhibited a number of drawbacks. As an illustration, the heat generated by the Joule effect in the pyrolytic graphite blocks was transmitted to the cap member almost entirely through the surfaces in contact since the geometry of the assembly was such that most of the radiation emitted by the blocks was unable to reach the cap. As a result, the thermal efficiency of these cathodes was low. In addition, due to thermal expansion the mounting of the cap and the blocks between two rigid arms often gave rise to excessive mechanical stresses, and it was difficult to secure good positioning of the cap because of thermal fluctuations.

SUMMARY

One general object of this invention, therefore, is to provide a new and improved cathode for an electron gun.

More specifically, it is an object of this invention to provide such a cathode which exhibits improved thermal efficiency over its operating range.

Another object of the invention is to provide a cathode of the character indicated which avoids the deleterious effects of thermal expansion and contraction.

Still another object of the invention is to provide a cathode utilizing comparatively straightforward mechanical and electrical components which is economical to manufacture and thoroughly reliable in operation.

In one preferred embodiment of the invention, the cathode includes a cap in the form of a hollow member which is mounted on a support in fixed relationship with the electron gun. The heater element is located at least partly within the recess formed by the hollow cap and is disposed so as to abut an internal wall thereof. With this arrangement the transmission of heat occurs not only by conduction between the surfaces in contact with each other but also by radiation since the greater part of the radiation emitted by the heater falls on the cap. As a result, the thermal efficiency of the overall assembly is substantially improved.

In accordance with a further characteristic of the invention, in a number of important embodiments, the cap and the heater are circular and in coaxial relationship with each other. The resulting rotational symmetry provides a more nearly uniform distribution of the heat radiated by the heater, and hence a uniform temperature of the cap, and it further simplifies fabrication.

In accordance with another characteristic of several embodiments of the invention, the cap is cup-shaped with a flat internal bottom wall and an internal side wall which flares out from the bottom wall. The heater, on the other hand, has the shape of a frustum of a cone whose upper or vertex surface is held against the bottom wall of the cap. The arrangement is such that the mounting and centering of the various components of the cathode are greatly facilitated.

In accordance with still another characteristic of the invention, in certain good arrangements, the cathode also includes an electrically conductive shell overlying the cap. The shell is mounted directly on the cap support structure and holds the cap in place without the need for welding the cap to the support, thus reducing any chemical reaction between the cap and the support.

Also in accordance with an important characteristic of certain embodiments of the invention, the heater element is resiliently maintained in position against the cap. This arrangement further reduces the generation of mechanical stresses due to thermal expansion.

These and other characteristics and advantages of the invention will become more fully apparent from the following description of a preferred embodiment thereof, when read with reference to the accompanying drawing.

BRIEF DESCRIPTION OF THE DRAWING

The single drawing FIGURE is a transverse vertical sectional view, with certain parts shown schematically, of a cathode for an electron gun in accordance with a preferred embodiment of the invention.

DESCRIPTION OF A PREFERRED EMBODIMENT

In accordance with the illustrated embodiment, the cathode according to the invention, generally designated 1, is disposed inside a cylindrical electron gun shown diagrammatically at 2. The cathode 1 is concentric with a thin annular base plate 3 rigidly affixed to the inner cylinder wall of the gun 2. Apart from the cathode 1, the gun 2 comprises, in a manner not novel as such, a number of other elements, in particular one or more magnetic lenses, an anode, and a Wehnelt cylinder, which alone is shown at 4. The gun 2 and the assembly of elements which it comprises are coaxially mounted about a vertical axis X—X'.

The cathode 1 includes an electron emitting cap member 10. The cap member 10 is of circular cross-section and of inverted cup-shaped configuration to provide an internal recess having a flat bottom surface 10*a* and an outwardly flared cylindrical side wall 10*b*. The cap is fabricated from lanthanum hexaboride or similar material capable of emitting electrons at an elevated temperature.

A cylindrical shell 11 is disposed around the outer periphery of the cap member 10 in abutting relationship therewith. The shell 11 is in the form of a tubular cylinder having an inwardly sloping shoulder 11*a* at its upper end for holding the cap in place. The lower portion of the shell 11 forms an outwardly projecting flange 11*b*.

The cathode assembly is maintained in position within the electron gun 2 by a support indicated generally at 12. The support 12 is formed by upper and lower frustoconical cups 12*a* and 12*b*, respectively which are rigidly secured to the corresponding upper and lower surfaces of the base plate 3. The upper cup 12*a* is affixed to the outer cylindrical surface of the shell 11 to center the shell and hence the cap 10 within the central opening 42 of the Wehnelt cylinder 4.

A heater element 14 is at least partially disposed within the recess in the cup-shaped member 10. The heater 14 is of pyrolytic graphite or other material of high electric resistivity and is shaped to form a frustum of a cone whose top and base are designated 14*a* and 14*b*, respectively. The top 14*a* comprises the vertex surface of the cone and is resiliently maintained in abutting relationship with the flat inner surface 10*a* of the cap member 10 in a manner that will become more fully apparent hereinafter. As a result of an axial cavity 14*c* in the heater 14, the surface 14*a* is of ring-shaped configuration. To facilitate the placement and centering of the heater 14 in the cap 10, the surfaces 10*a* and 14*a* have substantially the same diameter, and the heater has a vertex angle that is slightly smaller than that of the inner flared rim 10*b* of the cap.

The heater 14 is resiliently held against the cap member 10 by means of a push rod 15 in coaxial relationship with the cylindrical gun 2. The upper end of the push rod 15 has a head 15*a* which supports the heater 14, while the lower end of the push rod is provided with a metal ring 16. The ring 16 is fixed to an upwardly extending tubular member 17. The tubular member 17 in turn is fixed, through an insulating ring 18, to a second tubular member 19, and this latter member abuts an insulating ring 25 which is disposed around the adjacent end of a rod 20. The tube 17 is disposed within the tube 19 and the push rod 15 is disposed within the tube 17 such that each of these components is coaxially located along the axis X—X′ of the electron gun.

The push rod 15 and the tubular members 17 and 19 form a rigid assembly whose function is to transmit thrust from a resilient mounting member 23 to the heater 14. The member 23 comprises a corrugated sheath which surrounds the tubular member 19. The sheath is fixed at its upper end 23*a* to the cup 12*b* of the support 12 and at its lower end 23*b* to an annular collar 24. The collar 24 abuts the insulating ring 25 at the lower end of the tubular member 19.

The assembly formed by the push rod 15 and the tubular members 17 and 19 serves the further purpose of producing a substantial temperature drop between the heater 14, whose temperature is of the order of 1,700° C., and the corrugated sheath 23. With this arrangement the temperature of the sheath 23 and the supporting rod 20 is reduced to about 200° to 300° C.

To limit radiant heat transmission from the heater 14 to the gun 2, the cathode 1 is further provided with two frustro-conical shields 26 and 27. The shield 26 is located within the cup 12*b* with its lower, vertex end secured to the upper end of the tubular member 17 and its opposite end positioned immediately beneath the heater. The shield 27, on the other hand, is externally disposed above the cup 12*a* and is supported on the base member 12. The vertex end of the shield 27 surrounds the outer side wall of the heater.

The cap member 10 and the heater member 14 are traversed in series by an electric current in a conventional manner to heat the member 14 to a comparatively high temperature. Because of the relative placement of the cap member 10 and the heater member 14, and in view of the cylindrical form of these members, substantially all of the energy radiated by the heater 14, and in particular by its conical surface, is absorbed by the cap 10. The absorbed radiant heat combines with the heat conducted from the ring-shaped heater surface 14*a* to the cap to provide substantially improved thermal efficiency and better cathode performance.

Moreover, the resilient support provided by the corrugated sheath 23 protects the cap and the heater from the mechanical stresses encountered with rigid systems and thus considerably lengthens the service life of the cathode.

Although the invention is applicable to a wide variety of electron beam generators and other apparatus utilizing heated cathodes, it is particularly well suited for use with electron beam welding equipment and electron microscopes, for example.

It will be appreciated that various modifications may be made to the embodiment described and illustrated without departing from the spirit and scope of the invention.

What is claimed is:

1. A cathode for an electron gun, the cathode comprising, in combination:

a cap member having an internal recess and being of a material capable of emitting electrons at an elevated temperature;

support means for mounting the cap member on the electron gun;

a heater element of high electric resistivity at least partially disposed within the recess in the cap member; and mounting means for maintaining the heater element in abutting relationship with the cap member.

2. A cathode for an electron gun, the cathode comprising, in combination:

a cap member of circular cross-section, the cap member having an internal recess and being of a material capable of emitting electrons at an elevated temperature;

support means for mounting the cap member on the electron gun;

a heater element of high electric resistivity and of circular cross-section at least partially disposed within the recess in the cap member; and mounting means for maintaining the heater element in abutting coaxial relationship with the cap member.

3. A cathode as defined in claim 2, in which the cap member is of cup-shaped configuration.

4. A cathode for an electron gun, the cathode comprising, in combination:

a cap member of circular cross-section, the cap member having a flared internal recess and being of a material capable of emitting electrons at an elevated temperature;

support means for maintaining the cap member in rigid relationship with the electron gun;

a heater element of high electric resistivity at least partially disposed within the recess in the cap member, the heater element being of frustroconical configuration;

mounting means for maintaining the vertex surface of the heater element in abutting relationship with the cap member.

5. A cathode as defined in claim 4, in which the vertex surface of the heater element is of annular configuration.

6. A cathode for an electron gun, the cathode comprising, in combination:

a cup-shaped cap member of circular cross-section, the cap member having an internal recess and being of a material capable of emitting electrons at an elevated temperature;

support means for maintaining the cap member in rigid relationship with the electron gun;

a heater element of high electric resistivity at least partially disposed within the recess in the cap member; and mounting means for resiliently maintaining the heater element in abutting relationship with the cap member.

7. A cathode for an electron gun, the cathode comprising, in combination:

a cup-shaped cap member of circular cross-section, the cap member having an internal recess and being of a material capable of emitting electrons at an elevated temperature;

support means for maintaining the cap member in rigid relationship with the electron gun;

a heater element of high electric resistivity at least partially disposed within the recess in the cap member;

mounting means for maintaining the heater element in abutting relationship with the cap member; and an electrically conductive shell carried by the support means adjacent the cap member.

8. A cathode as defined in claim 7, in which the shell comprises a generally tubular cylinder having an internal shoulder abutting the cap member.

9. A cathode for an electron gun, the cathode comprising, in combination:

a cap member of circular cross-section, the cap member having an internal recess and being of a material capable of emitting electrons at an elevated temperature;

support means for maintaining the cap member in rigid relationship with the electron gun;

a heater element of high electric resistivity at least partially disposed within the recess in the cap member; and mounting means for resiliently maintaining the heater element in abutting relationship with the cap member, the mounting means including a corrugated tubular member carried by the support means for holding the heater element in the recess in the cap member.

10. A cathode for an electron gun, the cathode comprising, in combination:

a cap member of circular cross-section, the cap member having internal recess and being of a material capable of emitting electrons at an elevated temperature;

support means for maintaining the cap member in rigid relationship with the electron gun;

a heater element of high electric resistivity at least partially disposed within the recess in the cap member; and mounting means for resiliently maintaining the heater element in abutting relationship with the cap member, the mounting means including a rod having one end connected to the heater element, a corrugated tubular member affixed to the support means and a pair of rigid interconnected tubes for connecting the tubular member to the other end of the rod, said tubes being disposed within said corrugated member and said rod being disposed within said tubes.

11. A cathode as defined in claim 10, in which the heater element is of circular cross-section and includes an axial opening therein, said one end of said rod being disposed in said axial opening.

12. A cathode as defined in claim 10, which further comprises a ring member of insulating material for interconnecting said tubes.

13. A cathode for an electron gun, the cathode comprising, in combination:

a cup-shaped cap member of circular cross-section, the cap member having an internal recess and being of a material capable of emitting electrons at an elevated temperature;

support means for maintaining the cap member in rigid relationship with the electron gun;

a heater element of high electric resistivity at least partially disposed within the recess in the cap member;

mounting means for maintaining the heater element in abutting relationship with the cap member; and shielding means in close juxtaposition with the heater element for intercepting thermal radiation therefrom.

14. A cathode as defined in claim 13, in which the shielding means comprises a pair of generally conical shielding members carried by the support means.

15. A cathode for an electron gun, the cathode comprising, in combination:

a cup-shaped cap member of circular cross-section, the cap member having a flared internal recess and being of a material capable of emitting electrons at an elevated temperature;

support means for maintaining the cap member in rigid relationship with the electron gun;

a heater element of high electric resistivity at least partially disposed within the recess in the cap member, the heater element being of frustroconical configuration and including an axial opening therein;

mounting means for resiliently maintaining the vertex surface of the heater element in abutting relationship with the cap member, the mounting means including a rod having one end disposed in the axial opening in the heater element, a corrugated tubular member affixed to the support means, and a pair of rigid interconnected tubes for connecting the tubular member to the other end of the rod, said tubes being disposed within said corrugated member and said rod being disposed within said tubes;

an electrically conductive shell carried by the support means adjacent the cap member; and shielding means in close juxtaposition with the heater element for intercepting thermal radiation therefrom.

* * * * *